United States Patent [19]

Compton

[11] Patent Number: 4,819,394

[45] Date of Patent: Apr. 11, 1989

[54] QUICK-CONNECT LATERAL FORCE COUPLING

[75] Inventor: Lloyd A. Compton, Visalia, Calif.

[73] Assignee: M & J Operations Corporation, Visalia, Calif.

[21] Appl. No.: 116,070

[22] Filed: Nov. 2, 1987

[51] Int. Cl.[4] ..... E04B 1/00

[52] U.S. Cl. ..... 52/252; 52/253; 52/284; 52/584

[58] Field of Search ..... 52/695, 250, 251, 252, 52/253, 284, 285, 584

[56] References Cited

U.S. PATENT DOCUMENTS

| | | | |
|---|---|---|---|
| 1,957,026 | 5/1934 | Casker | 52/252 X |
| 3,300,943 | 1/1967 | Owens | 52/252 X |
| 3,855,744 | 12/1974 | Miram | 52/284 |
| 4,070,808 | 1/1978 | Danescu | 52/285 |
| 4,441,289 | 4/1984 | Ikuo et al. | 52/252 X |
| 4,612,747 | 9/1986 | Andrä et al. | 52/250 |

*Primary Examiner*—David A. Scherbel
*Assistant Examiner*—Creighton Smith
*Attorney, Agent, or Firm*—Christie, Parker & Hale

[57] ABSTRACT

A precast reinforced concrete exterior wall panel is connected in a building between supporting columns by connectors which enable the panel to carry lateral shear loads in the building. As precast, the panel includes encased but not embedded steel straps which extend end to end in the panel for carrying loads applied to the panel ends via the connectors. The connectors include face abutting mating moieties. The mating faces of each moiety defines a regularly repeating grid pattern of projections and recesses so arranged that the moieties are engageable in face abutting relation with the projections of each engaged in the recesses of the other at any of a plurality of discrete relative positions of the moieties. When so engaged and clamped together, the connector moieties cooperate to carry shear loads across the plane of the mated faces. One moiety is connected to a panel strap end and the other is embedded in or affixed to an adjacent column. The one moiety is adjustably positionable on the strap end so that, with other aspects of the connector, substantial positional variations between the columns can be accommodated without adverse effect upon the shear capacity of the connector.

57 Claims, 5 Drawing Sheets

Fig. 11

| PANEL CONNECTION TABLE | | | | | | | |
|---|---|---|---|---|---|---|---|
| LEVEL | STRAP SIZE | EDGE DIST. | S | FRICT. BOLTS | DOUBLER END PL. | LENGTH OF 1/4" WELD | NO. OF 1" X 4" EARS 44 ON MEMBERS 37 |
| ROOF | PL 3/8 X 4-1/2 | 3-3/4" | 4-1/2" | 2EA 1-1/8" | PL 7/16 X 4 X 10-1/4 | 4" | 2 |
| 6 | PL 3/8 X 5-1/2 | 3-3/4" | 4-1/2" | 2EA 1-1/8" | PL 7/16 X 5 X 10-1/4 | 6" | 2 |
| 5 | PL 1/2 X 5-1/2 | 3" | 3-1/2" | 2EA 1-1/8" | PL 3/8 X 5 X 8-1/2 | 8" | 3 |
| 4 | PL 5/8 X 5-1/2 | 2-3/4" | 3-1/2" | 2EA 1-1/4" | PL 5/16 X 5 X 8-1/2 | 10" | 3 |
| 3 | PL 5/8 X 5-1/2 | 2-3/4" | 3-1/2" | 2EA 1-1/4" | PL 5/16 X 5 X 8-1/2 | 10" | 3 |
| 2 | PL 3/4 X 5-1/2 | 3" | 3-3/4" | 2EA 1-3/8" | PL 1/4 X 5 X 9-1/4 | 12" | 3 |
| 2* | PL 1/2 X 7-1/2 | 2-1/4" | 3-1/4" | 2EA 1-1/8" | PL 1/4 X 7 X 10-3/4 | 10" | 3 |
| * END BAYS OF TRANSVERSE FRAME ONLY. | | | | | | | |

QUICK-CONNECT LATERAL FORCE COUPLING

FIELD OF THE INVENTION

This invention pertains to quick-connect couplings useful in the erection of buildings. More particularly, it pertains to a face-abutting quick-connect coupling useful where loads are to be carried in the plane of the abutting faces. The presently preferred utility of the invention is in the mounting of precast concrete wall panels to columns in the erection of buildings.

BACKGROUND OF THE INVENTION

Multi-story reinforced concrete buildings recently built and currently being built in the United States follow one or the other of two different construction systems which both adhere, one more than the other, to a common design philosophy. One construction system is that of the poured-in-place ductile frame building where all steel reinforcing bars or rods (rebar) are placed in forms erected at the building site and concrete is poured into the forms around the rebar elements. Ductile frame buildings are substantially the structural equivalent, in reinforced concrete, of steel frame buildings. The other construction system uses precast reinforced concrete building components which are tied or knit together at the building site to provide a structure of the requisite lateral stability. For buildings of comparable height and size, reinforced concrete buildings built according to the ductile frame system cost from 10 to 15 percent more to erect than buildings using the precast component system. Despite the cost premiums, ductile frame systems are used in the construction of multi-story office buildings more frequently than precast component systems are used. Precast component systems are used frequently to build parking structures and the like, rather than office buildings.

The present design philosophy followed in the United States for precast concrete buildings, and for cast-in-place buildings, is to provide the requisite lateral stability for the building in massive shear walls and/or ductile frame to which all other parts of the building are tied in a secure manner. The shear walls may be windowless end walls of the building in combination with a substantially continuous diaphragm wall in the building at right angles to the end shear walls; such arrangements are often found in parking structures and other buildings, not office buildings, where windows are not specially desired. An alternate form of the same philosophy is the use of internal shear walls, at right angles to each other, which have limited penetrations, such as doorways, through them. Such main shear walls are relied upon to keep the building stable and erect when the building experiences loads such as those imposed by wind or seismic events, for example. This design philosophy is unattractive for use in designing multi-story office buildings or other buildings where substantial window area in all exterior walls is desired, and where open interior space is desired for flexible and economic usage of floor area and for efficient traffic flow. Nevertheless, multistory reinforced concrete office buildings, as high as 20 stories are known; they most commonly are of the poured-in-place ductile frame kind.

Further, present design approaches to precast concrete buildings do not well use precast concrete components because they cannot economically be tied together and to the shear walls. Presently, such components must either be welded to the shear walls or be knit to the shear walls by pouring concrete on the site into forms around rebars extending from the shear walls and from the adjacent precast components. Extensive use of on-site welding, or of on-site pouring, or both, detracts from the economics of off-site manufacture of precast concrete components.

The necessary lateral stability for precast concrete buildings can be obtained by reliance upon exterior wall panels which afford substantial window area and which extend between adjacent exterior columns of the building, provided that the connections of the wall panels to the columns can transmit lateral loads. Poured-in-place floor diaphragms can be provided with minimal use of forms to tie precast girders, beams and floor panels together and to the exterior wall panels to satisfy remaining requirements for building lateral stability. The important criterion is that the connections of the precast wall panels to the precast columns be adequate to carry loads of the magnitudes associated with design wind, seismic and other loads. Adequate connection integrity and capacity could be provided by use of welded or poured-in-place connections, each of which is expensive and, as noted, detracts from the manufacturing and installation economics associated with precast concrete components.

It is seen, therefore, that a need exists for a way to efficiently, effectively and economically connect precast reinforced concrete wall panels to columns in a reinforced concrete building with minimum use, preferably no use, of welding or of on-site pouring of concrete. Satisfaction of that need will enable the economic and safe erection of multi-story office buildings and the like having substantial window area in all exterior walls and having substantially open and uninterrupted floor spaces.

SUMMARY OF THE INVENTION

This invention addresses the need identified above. It provides an improved coupling arrangement useful in buildings of precast concrete construction for coupling, e.g., a precast reinforced concrete wall panel between two adjacent supporting columns. The improved coupling has structural parts, and follows a design philosophy, which are compatible with and productive of the several desirable features and properties discussed above.

Generally speaking, the coupling comprises, as principle moieties, a base member and an element member for association respectively with a precast building column and another element of a building, such as a wall panel. Each of the base and element members have a mating end portion which defines a generally flat yet locally contoured mating surface. The base member has a base portion which is adapted to be securely affixed to a building column with the mating surface thereof disposed in a desired plane relative to the column. The element member has a connection part adapted to be connected to a selected part of a building wall element. The element member is also adapted to be coupled to the base member by engagement of its mating surface with that of the base member and by clamping together the mating end portions of the two members. The mating surface of each coupling moiety is contoured to define, in a manner essentially identical to that of the other moiety's mating surface, a regular pattern of projections and recesses in each of two orthogonal directions in the surface. The dimensions of the projections and recesses, in combination with the area of them on the mating surfaces and with the material of which the moieties are defined, provide a joint of desired shear strength substantially in the plane of the mating surfaces when the surfaces are engaged with the projections of one disposed in the recesses of the other and the mating ends are clamped together.

DESCRIPTION OF THE ACCOMPANYING DRAWINGS

The above mentioned and other features of this invention are more fully set forth in the following detailed description of a presently preferred embodiment of this invention, which description is presented with reference to the accompanying drawings, wherein.

Figure 9:
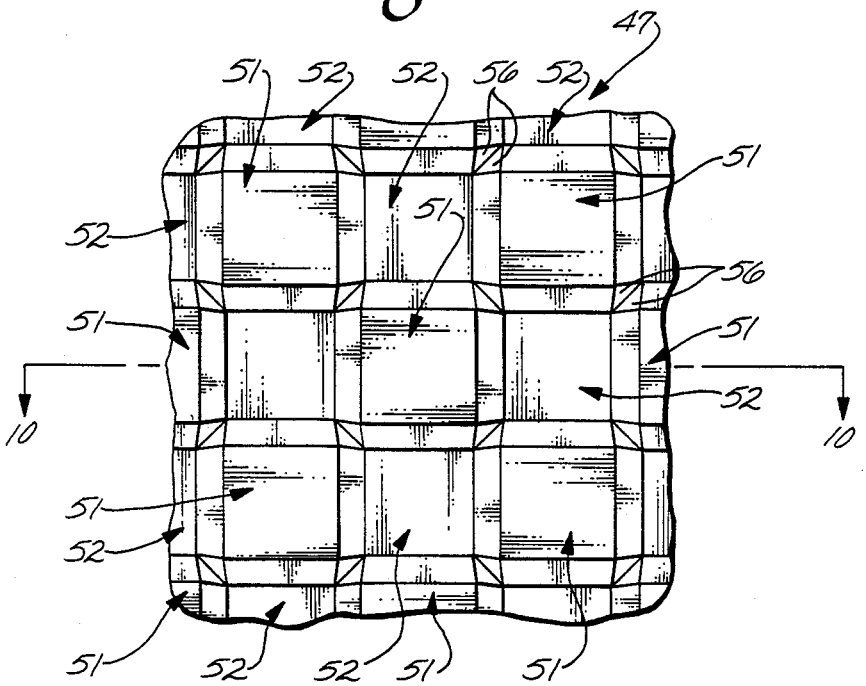
FIG. 9 is an enlarged fragmentary elevation view of the repeating pattern of projections and recesses formed on the mating surfaces of the connector moieties shown in FIGS. 5 and 7, for example, and which, upon mating of the moieties, provide an interlocking grid resistant to lateral shear.
Figure 10:
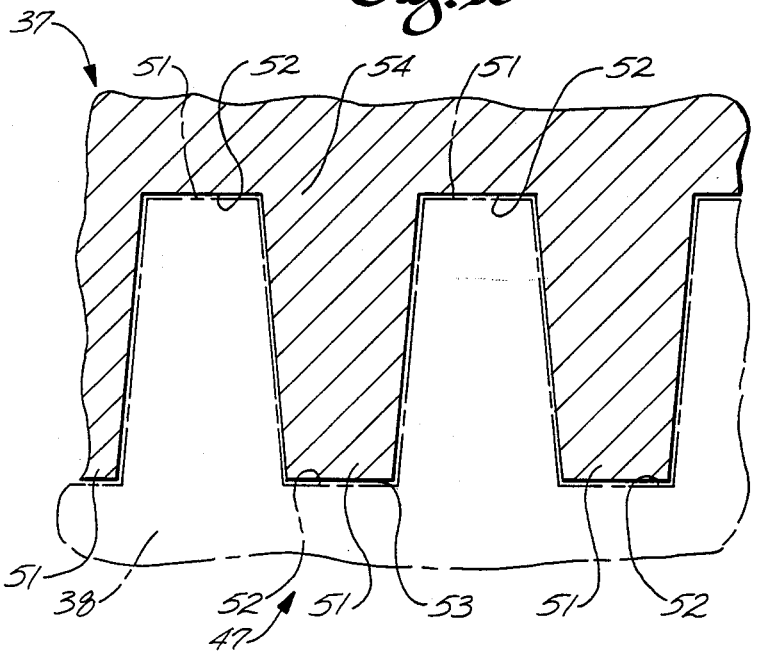

FIG. 10 is a fragmentary cross-section view taken along line 10—10 in FIG. 9; the phantom lines shown in FIG. 10 represent the corresponding features on the other principal moiety of the connector and show how the recesses and projections of the respective moieties cooperate upon mating of the moieties; and FIG. 11 is a table which sets forth the dimensions and other criteria pertinent to the panel-to-column connections in the building according to the presently preferred embodiment of the invention.

DESCRIPTION OF THE ILLUSTRATED EMBODIMENT

Figure 1:
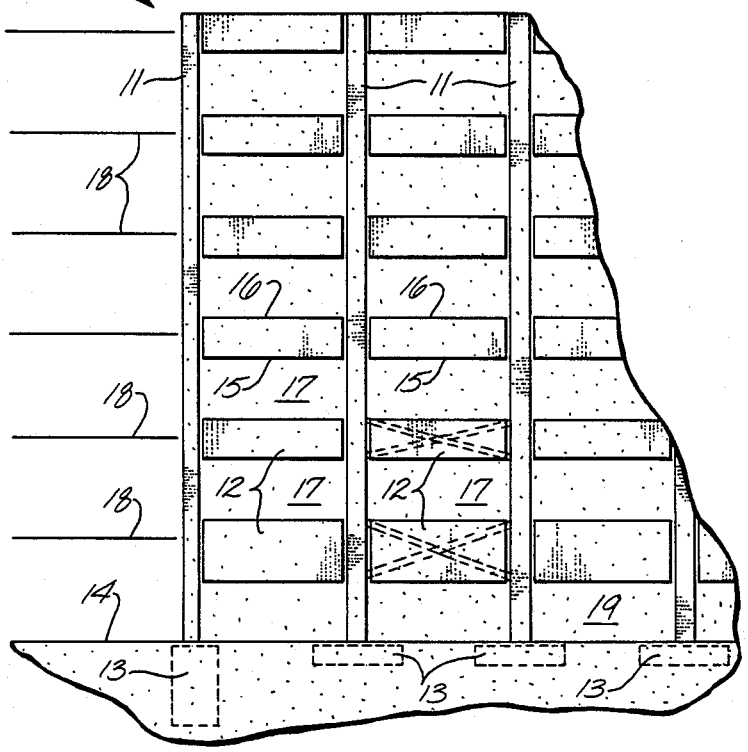
FIG. 1 is a fragmentary elevation view of a portion of a multi-story office building according to, and incorporating components consistent with a presently preferred embodiment of, this invention.

FIG. 1 is a fragmentary elevation view of a corner of a six-story office building 10. The exterior of the building is defined by a plurality of columns 11 which are interconnected by precast wall panels 12 at approximately the levels in the building where the second through sixth floors and the roof occur. The columns and the wall panels are precast reinforced concrete components of the building which preferably are manufactured remote from the site of the building at a factory where the necessary rebar frames and pouring forms are fabricated and used to define the building components more economically and efficiently than at the building site. The columns are erected on suitable footings or foundations 13 defined at or below ground level 14 in a known manner.

Figure 3:
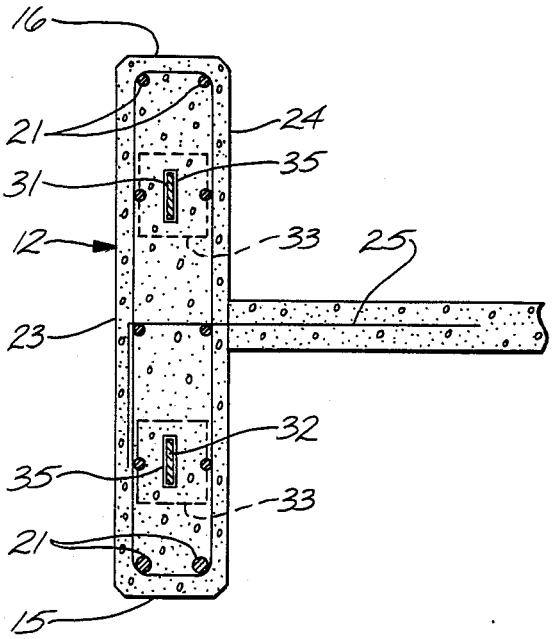
FIG. 3 is a cross-sectional elevation view taken along line 3—3 of FIG. 2.

It will be understood that within the building the columns are interconnected at the floor and roof levels by precast reinforced concrete joists, girders and floor slabs, over which a diaphragm floor slab may be poured in place to interconnect and knit together the various precast components of the building in the manner shown, for example, in FIG. 3.

Precast reinforced concrete wall panels 12, as viewed from the exterior of the building, are of rectangular shape and are disposed at such levels in the building that their lower edges 15 and upper edges 16 cooperate to define window areas 17 below and above the respective floor levels 18 of the second and higher floors and of the roof. That is, each of the wall panels vertically traverses the corresponding floor or roof level. The space between the lower edges of the wall panels associated with the second floor and ground level 14 are closed by windows and doors as appropriate.

Figure 2:
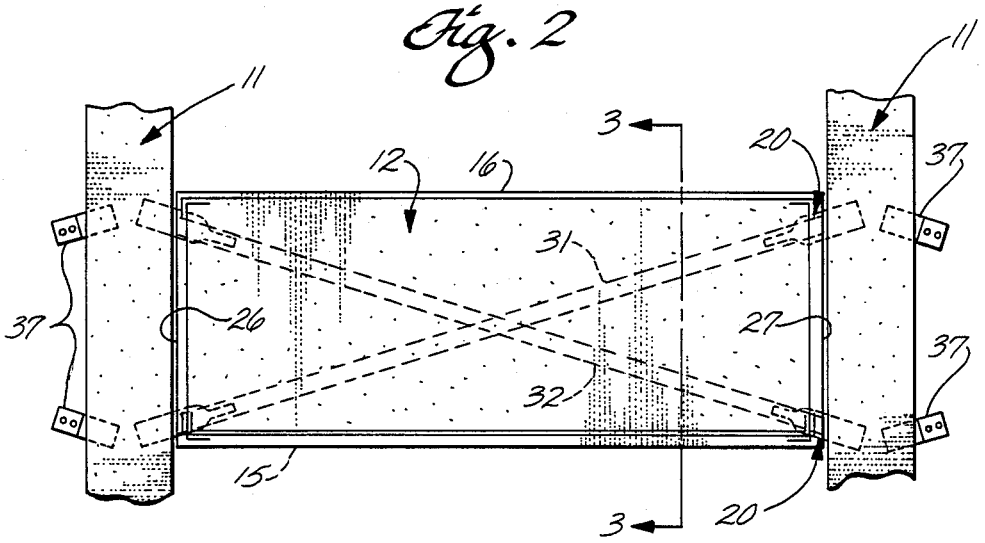
FIG. 2 is a fragmentary elevation view showing a precast reinforced concrete wall panel connected between adjacent columns in the building shown in FIG. 1.

FIG. 2 shows a wall panel 12 connected between an adjacent pair of columns 11 through the agency of quick-connect load-transmitting connectors 20 which are an aspect of this invention. Details of a presently preferred connector are shown in FIGS. 4 through 10. As shown best in FIG. 3, which is a cross-section view taken along line 3—3 in FIG. 2, the wall panel is a precast reinforced concrete article having essentially all of its exterior surfaces and the majority of its volume defined by concrete. In the concrete are embedded steel reinforcing bars and rods (rebar) 21 of appropriate size and number and location determined in a known manner. The rebar elements are interconnected in a known manner to define a reinforcing framework in the concrete. Wall panel 12 has an exterior face 23 and an interior face 24. Selected ones of rebar elements 21 within the wall panel are extended, as indicated at 25, from the rear face of the wall panel substantially in a common plane disposed parallel to the length of the wall panel between its opposite ends 26 and 27 at a selected position between the lower and upper edges of the wall panel. The exposed reinforcing rods 25 are embedded in a cast-in-place floor slab 29, for example, which is poured after the wall panel has been mounted between an adjacent pair of columns 11 by use of connectors 20 as described below. Thus, rods 25 serve within building 10 to aid in interconnecting and knitting together the elements of the building in ways supplemental to the connection of the wall panel to its supporting columns via the use of connectors 20.

In connection with the use of connectors 20 to mount wall panels 12 between columns 11, each wall panel 12 carries within it a pair of steel straps 30, 31. As shown in FIG. 3, the straps are disposed in a plane substantially midway between and parallel to wall panel faces 23 and 24. As shown best in FIG. 2, strap 31 is disposed substantially along one diagonal of the rectangular wall panel and strap 32 is disposed substantially along the other diagonal. Each strap preferably is disposed centrally within a cage of welded wire fabric 33 which is positioned within the network of rebar elements within the wall panel and which surrounds the adjacent strap along substantially the entire extent of the strap within the wall panel. Each of straps 31 and 32 is not itself bonded to the concrete which forms the principal material of each wall panel. Rather, within that portion of its length which is surrounded by concrete in the wall panel, each strap 31, 32 is encased in a plastic sheath 35 within which the strap can move longitudinally while the sheath is bonded to and held stationary by the surrounding encapsulating concrete.

The diagonal disposition of straps 31 and 32 in each panel 12 is the presently preferred disposition of the straps in the panels. If desired, however, the straps can be disposed parallel to the length of the wall panel desired distances below and above the upper and lower edges of the panel. The principal function of the straps in the panels is to accept and to carry between adjacent columns tensile and compressive loads which might be imposed upon the panels by movement of the columns laterally relative to each or in a swaying manner. The loads due to the weight of the panel itself, as well as lateral tensile and compressive loads imposed upon the panel by movement of adjacent columns away from or toward each other, as by reason of wind or seismic loads, are carried by connectors 20 which are provided between each corner of each wall panel and the adjacent column.

Assume a panel 12 is in place in building 10 between a pair of columns 11 and assume the building is subjected to seismic loading. In such event, the columns between which the panel is mounted may tend to sway out of alignment with respective plumb lines. Such swaying movement of the columns is resisted by wall panel 12, a principal purpose of which is to impart lateral stability to the building. As the columns tend to sway, one diagonal of the panel tends to elongate and the other tends to grow shorter. The diagonal which tends to elongate has relevant tensile loads carried by the corresponding one of straps 31 and 32. The diagonal which tends to grow shorter has its corresponding strap loaded in compression, so that strap tends to buckle. However, the weld wire fabric cage 33 embedded in the panel concrete around the latter strap assists the concrete in maintaining the strap straight along its length so that the strap cannot buckle and so that the strap and the surrounding concrete can effectively carry the compressive loads which cause the strap to tend to buckle.

As shown best in FIGS. 4 through 8, each connector 20 includes two principal elements or moieties, namely, a base member 37 which is adapted to be securely affixed to a column 11, and a component member 38 which is adapted to be connected to a selected element or component of building 11, such as wall panel 12, which is to be connected to a column. Inasmuch as member 38 of each connector is associated with a building component or element other than a column, such member is referred to as the element or component member of the connector assembly. Member 37 need not always be affixed to a column, although that is its preferred use. It is contemplated that, at the time the connector is made up or assembled, member 37 will be stationary, and so it is referred to as the base member of the connector assembly. Other terms which may be used to refer to members 37 and 38, respectively, are first and second members.

The connector base and component members 37 and 38 preferably are defined as ductile iron castings. If desired, they may be defined as machined forgings or in any other manner consistent with the functions which they are to serve in the practice of this invention, which functions include the transfer of substantial shear loads substantially in the planes of their mating surfaces.

Figure 4:
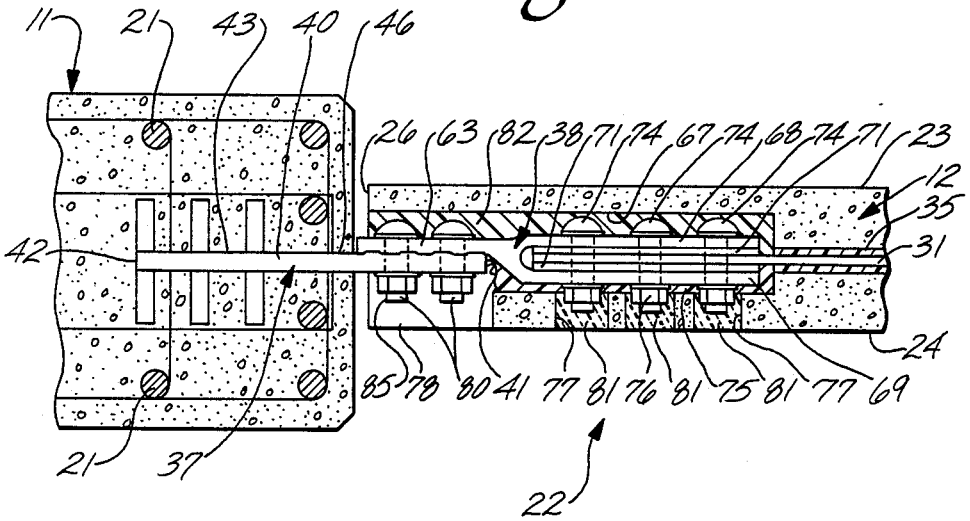
FIG. 4 is a cross-sectional plan view of the components constituting a presently preferred connector according to this invention for connecting a precast wall panel to a precast column.
Figure 5:
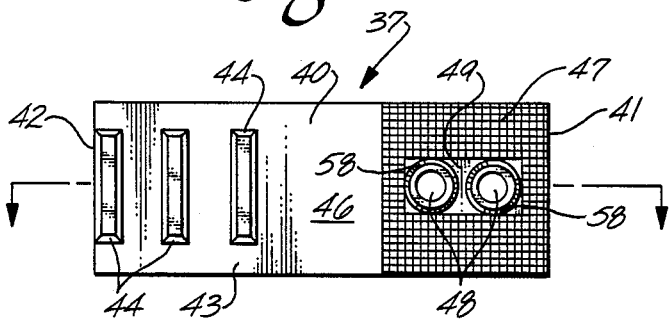
FIG. 5 is an elevation view of a base member which is a one of the two principal moieties of the connector shown in FIG. 4 and which is associated with the column in the illustration of the connector shown in FIG. 4.
Figure 6:
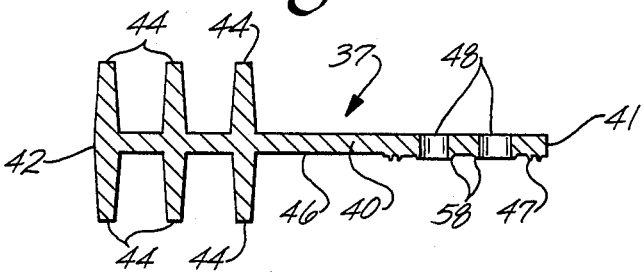
FIG. 6 is a cross-section view taken along line 6—6 in FIG. 5.

As shown in FIGS. 4, 5 and 6, base member 37 has an elongate, preferably rectangular and preferably flat body 40 having a mating end 41 and an opposite mounting end 42. A portion of body 40 adjacent mounting end 42 comprises a base or mounting portion 43 of the member. As shown best in FIG. 6, a plurality of ear-like embedment projections 44 are carried preferably integrally with the member and extend away from each of the opposite faces of the substantially planar member at spaced locations along the length of the member, including preferably at its mounting end 42. There preferably are the same number of embedment projections on one side of the base member as there are on the other side, and preferably those on one side are aligned in common planes with those on the other side. The embedment projections preferably are disposed so that they extend substantially perpendicularly from the basic plane of member 37 and are elongated both in directions perpendicular to the base member as well as transversely of the elongate extent of the base member. Depending upon the location of a given base member in building 10 and upon the magnitudes of the loads which it is required to carry in use, there are more or less of the embedment projections on each side of the base member; in the presently preferred embodiment of this invention there are either two or three of projections 44 on each side of the base member. In a presently preferred form of base member, the body of the base member is about 19¼ inches long, is 1 inch thick, and has 1 inch thick projections 44 which extend 3 inches perpendicularly from the plane of the base member and which have a height of 4 inches transversely of the length of the base member; that same base member has a width of 7 inches. The projections are approximately 1 inch thick and have their opposing faces spaced about two inches from each other.

As shown in FIGS. 2 and 4, the base portions 43 of connector members 37 are disposed within a respective column 11 so that they are embedded in the concrete from which the column is cast and within the rebar framework which is also embedded within the cast column. The base members are located at predetermined positions along the length of the column and are disposed so that the mating end portion of each member extends from a pertinent exterior face of the column substantially in a plane perpendicular to that face. Furthermore, as shown in FIG. 2, each base member, as embedded in the column, has its length disposed at a desired angle relative to the length of the column, which angle corresponds to the angle which the corresponding strap 31 or 32 in a particular wall panel 12 will make relative to the length of the column when the wall panel is placed in position in the building in the proper position adjacent the related mounting member. For example, the angle by which a given mounting member 37 has its length disposed to deviate from being perpendicular to the length of column 11 is equal to the angle by which the corresponding strap 31, 32 in the relevant wall panel deviates from being parallel to the length of the wall panel.

The several mounting members 37 associated with a given column 11 can conveniently be embedded within the precast column at the desired locations along the column, and in the desired orientations relative to the column, by use of suitable jigs or the like built into the forms which are used for precasting columns 11 at a manufacturing site remote from the site at which building 10 is to be constructed. In this way, very precise control over the positions and attitudes of the several mounting members embedded in any column 11 can be achieved substantially more efficiently and economically than if the mounting members were to be disposed in a cast-in-place column which, in the instance of a multi-story building such as building 10 shown in FIG. 1, likely would be cast in increments at different times in the course of construction of the building. Thus, while connectors 20 can be used in the process of erecting a reinforced concrete building which has its columns poured in place at the building site, it will be apparent that the preferred utility of the connectors is in the context of a building incorporating precast columns and related other components such as wall panels 12.

Adjacent its mating end 41, one side surface 46 of the body of base member 37 is locally contoured to define a mating grid 47. In the presently preferred base member having the dimensions described above, the mating grid covers the entire 7 inch width of body 40 and extends for about 7¼ inches along the length of the body from mating end 41 toward mounting end 42. A plurality of holes 48, preferably two holes, are defined through the thickness of the body within a central portion of the mating grid. The holes preferably are located along a line parallel to the length of body 40 midway between its opposite elongate edges, as shown in FIG. 5. It is preferred that a desired area 49 of the mating portion of the base member in which holes 48 are located is unfeatured in the manner characteristic of mating grid 47.

The details of mating grid 47 on base member 37, and also of the mating grid on the mating end portion of component member 38, is shown in the enlarged fragmentary views of FIGS. 9 and 10 in which FIG. 9 is an elevation looking toward the basic plane of surface 46 of base member body 40 and in which FIG. 10 is a section view taken along line 10-10 in FIG. 9. The mating grid on each moiety of connector assembly 20 comprises a contour of mating surface 46 which is essentially identical to that of the other moiety's mating surface. The mating grid comprises a regular pattern of projections 51 and recesses 52 in each of two orthogonal directions in the mating surface preferably along and transversely of the length of the member. The dimensions of the projections and recesses, in combination with the area thereof on the mating surfaces of the moieties and in combination with the material of which the coupling moieties are defined, provides a joint of desired shear strength substantially in the plane of the moieties' mating surfaces when the mating surfaces are engaged with the projections of one mating surface disposed in the recesses of the other surface and with the mating end portions of the two moieties clamped together. The recesses 52 and projections 51 preferably are substantially square with the sides of the projections and recesses being disposed parallel to and transversely of the elongate extent of the respective connector moiety. The projections and recesses are disposed alternately in rows along the length of the member and also in columns at right angles to such length. As a result, the projections are aligned in juxtaposed relation along lines which extend diagonally of the respective moiety, whereas the recesses are also positioned in juxtaposed relation along intermediate diagonal lines. Each side surface of each projection preferably defines a side surface of an adjacent recess. The four sides of each projection are sloped somewhat so that the end 53 of each projection has a smaller area than the projection has at its base 54 in a base plane 55 of each mating grid. The base plane of each mating grid can be coincident with the adjacent surface of the planar mating portion of the corresponding moiety, or it can be displaced slightly from but parallel to such surface. In effect, the contour of each projection is substantially a mirror image of or negative of each recess. In other words, the mating surfaces are contoured as conjugates of each other.

It is preferred, as shown in FIG. 9, that each corner of each projection is chamfered decreasingly from its base 54 to its opposite end 53 as indicated at 55. The taper of the projections in each of the two relevant orthogonal directions is consistent with the preferred method of fabrication of the respective coupling assembly moiety by casting; it also facilitates efficient mating of the projections on each moiety's mating end portion with the recesses of the other moiety upon assembly of the connector in the manner described below.

In the presently preferred embodiment of the invention for which certain dimensions of base member 37 have been given above, the preferably flat ends 53 of projections 51 are disposed parallel to corresponding base surface 55 and are spaced 7/32 inch therefrom. The end surface of each projection is ⅛ inch square, whereas the base 54 of each projection is 3/16 inch square. The distance between adjacent projections 51 in each of the two relevant orthogonal directions in base plane 55 is slightly greater than ⅛ inch so that each recess is slightly wider in base plane 55 and at its open end than is each projection at its end 53 and at its base, respectively. A clearance tolerance is thus provided which enables the projections and recesses on the mating surfaces of the principal moieties of each connector to mate easily yet snuggly with each other upon engagement of those mating surfaces upon assembly of each connector.

An annular flat land 58 (see FIG. 5) is defined around each hole 48 within unfeatured area 47 in the central part of the mating grid 47 of each connector moiety 37, 38. The height of each land 58 is approximately one-half the distance between the base and tip ends 54, 53 of each projection 51 in the respective mating grid. The lands 58 around the holes in the mating portions of each of moieties 37, 38 engage each other upon assembly of connector 20 to limit the extent to which the projections on one mating grid extend into the recesses on the other mating grid. As a result, upon assembly of the two moieties, a small clearance exists between the tip ends 53 of the projections on one moiety and the base surfaces of the recesses 52 of the other moiety; this is shown in FIG. 2 where the projection grid of base member 37 is shown in solid lines and the projection grid defined on the cooperating component member 38 is shown in broken lines.

Figure 7:
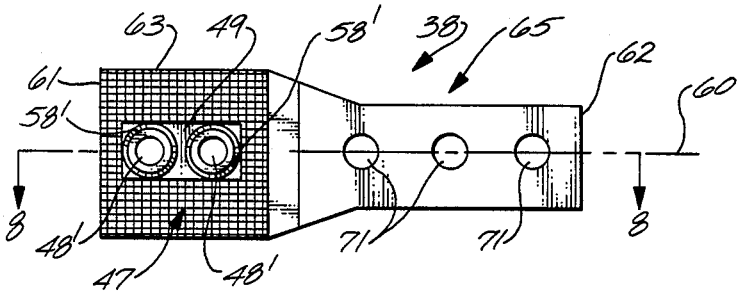
FIG. 7 is an elevation view of the element member which is the other principal moiety of the connector shown in FIG. 4 and which is associated with the wall panel as depicted in FIG. 4.
Figure 8:
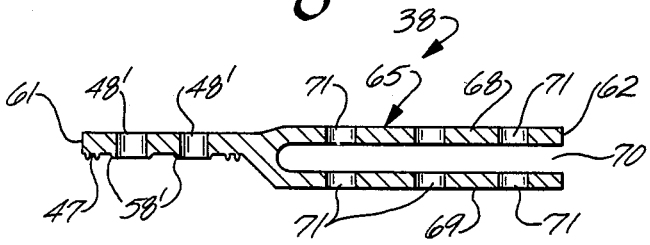
FIG. 8 is a cross-section view taken along line 8—8 of FIG. 7.

FIGS. 7 and 8 are, respectively, an elevation view of connector component member 38 and a cross-section view taken along line 8—8 in FIG. 7. The component member is elongate along a central axis 60 which is coincident with section line 8—8 in FIG. 7. The component member has a mating end 61 and an opposite mounting end 62. It has a mating end portion 63 adjacent its mating end which is a mirror image of the mating end portion of base member 47 in respect to its mating grid 47 but which is identical to the mating end portion of the base member in respect to its holes 48' and lands 58'. The mating end portion of component member 38 preferably has the same dimensions as the mating end portion of base member 37 in each connector 20.

The remaining portion of component member 38 between its mating portion and its connection end comprises a connection part of the member which adapts the member to be connected to a selected part or element of a desired component of building 10 which preferably is other than a column 11. Therefore, in the preferred exemplary connector 20 shown in the accompanying drawings, the connection part of connector member 38 (see FIGS. 7 and 8) is defined to adapt the component member to be connected to an end of strap 31, for example, of wall panel 12 in a recess 67 defined in the interior face 24 of the wall panel adjacent a corner of the panel. The recess preferably is formed in the course of casting the wall panel. The manner in which recess 67 can be defined in the wall panel during casting thereof is described below.

Component member 38 is adapted for coupling via its connection part to the end of panel strap 31 via a yoke composed of a pair of parallel elongate arms 68 and 69 (see FIGS. 4 and 8). Arm 68 is an inner arm in the sense that, upon positioning of component member 38 within wall panel recess 67, it is located more inwardly in the recess than is arm 69 which thus may be termed an outer arm. Inner arm 68 preferably lies substantially in the plane of the mating end portion of member 38, whereas outer arm 69 is offset from such plane, as shown in FIGS. 4 and 8. The distance between the opposing faces of arms 68 and 69, on opposite sides of a central space 70 between them, is slightly greater than the sum of (a) the thickness of strap 31 and (b) the aggregate thickness of two doubler plates 71 which are affixed, as by welding, to the opposite surfaces of the strap at its end within recess 67.

A plurality of holes 71 are formed through yoke arms 68 and 69 at spaced locations along the arms; the holes through one arm are coaxially aligned with the corresponding holes through the other arm. A corresponding number of holes are also formed through the strap and strap doubler plates at correspondingly spaced locations, preferably after doubler plates have been affixed to the opposite sides of the strap end. There are at least two holes 71 in each arm 68 and 69; there can be more if the magnitude of the loads to be transferred to a strap end are substantial. The spacing between the holes in each arm is a variable consistent with the invention, as is the distance between the mounting end of each arm and the nearest one of the holes; these variables are also related to the magnitude of loads to be transferred. The strap carries the doubler plates at its end within recess 67 to provide on the strap adequate bearing area to carry loads of a desired magnitude applied to the strap in either direction along the length of the strap by component member 38 in use of the connector. Such loads are applied to the strap from the component member via bolts 74 which are engaged in the yoke arm holes and through the strap holes in the manner shown in FIG. 4 in which the heads of the bolts cooperate with yoke inner arm 68 so that the shanks of the bolts project through and beyond the holes in the yoke outer arm. The threaded ends of the bolts which project beyond the yoke outer arm upon coupling of component member 38 to the end of strap 31 carry washers 75 and nuts 76. The nuts are accessible through the interior face of panel 12 as cast via access holes 77 defined in the wall panel as cast. Also, an access opening 78 is formed through the inner face 24 of the cast wall panel immediately adjacent to panel end 26 to afford lateral access to the mating end portion of component member 38 in the panel as cast and as prepared for connection between an adjacent pair of columns 11 in building 10.

It is preferred that bolts 74 be blind friction bolts of the kind marketed by Bristol Machine Company of Brea, Calif. Such a bolt has a frangible shank end portion (not shown in the accompanying drawings). Such a bolt has the feature that the nut can be tightened on the shank by the use of a special tool engageable only with the shank end of the bolt and with the nut. The tool has a chuck having a stationary central socket portion engageable with a spline defined on the frangible end of the bolt shank, and a relatively movable outer socket portion circumferentially of the tool's central socket; the outer socket is engageable with the adjacent nut. The nut is tightened on the bolt shank by engaging the socket outer part of the tool with the nut and the central socket portion of the tool with the frangible end of the bolt shank. The nut can be turned about a relatively stationary bolt shank until the nut is tightened on the shank to a desired tightness, at which point the torque between the two relatively angular movable parts of the tool exceeds the strength of the connection between the shank and its frangible end, at which time the frangible end of the bolt shears off. It will be seen, therefore, that friction bolts are the preferred means for connecting component member 38 to the end of strap 31 in blind recess 67 formed in wall panel 12 as cast. Such blind bolts are referred to by Bristol Machine Company as tension set fastener systems.

It is preferred that at the time the component member is first coupled to the strap end via friction bolts 74 and nuts 76, the nuts are left loose upon the bolts and are not tightened. The nuts 76 are left loose on the bolt shanks to afford a limited amount of movement of the component member relative to the strap end via the agency of the holes 71 through yoke arms 68, 69 being a selected amount oversize relative to the diameter of the bolt shanks which fit snugly in the holes through the doublered end of the wall panel strap.

Wall panel 12 preferably is manufactured at a location remote from the site of building 10, as in a precast concrete component factory, by laying up the network of rebar elements 21 for the wall panel in an appropriate casting form. Straps 31 and 32 and their welded wire fabric cages are disposed in the form within the rebar network and are held in desired positions within the network. As so positioned within the rebar network, straps 31 and 32 are encased along substantially their entire lengths by sheaths 35. At each of the its ends each strap carries a component member 38 loosely assembled on the doublered end of the strap in the manner described above. The end of the strap, with the component member thereon, preferably is encased in a frangible and deformable material 82, such as low density polystyrene or polyurethane foam, which has its exterior surfaces shaped to define recess 67 including access holes 77 to bolts 74 and nuts 76 and including access opening 78 to the mating end portion 63 of the component member. The portions of the encasement around the end of the strap and the component member also serves to hold a pair of friction bolts 80 in holes 48' of component member 38 with the heads of those bolts engaged with the inner surface of the component member mating end portion as shown in FIG. 4. The portion of the encasement around the strap end and the component member can be provided as a combination of separate pieces of polystyrene foam, e.g., including individual plugs 81 (which are represented in broken section lines in FIG. 4) for defining access holes 77. After casting of wall panel 12, plugs 81 can either be removed or broken away to provide the requisite access to bolts 74 and nuts 76, thereby to enable final positioning of the component member on the strap end at the time the wall panel is connected between a pair of columns 11 in building 10. Similarly, that portion of the encasement around the mating end portion of the component member for defining access opening 78 during casting of the wall panel can thereafter be broken away to expose the mating surface of the component member and the shanks of friction bolts 80 which project therefrom.

From the preceding description it is seen how columns 11 and wall panels 12 preferably are prefabricated as precast reinforced concrete components of building 10. As so prefabricated, they include the pertinent connector moieties for securing each wall panel between an adjacent pair of columns. At the building site, a wall panel is moved into place between and connected to its supporting columns after the columns have been erected on their respective foundations. Most commonly, a wall panel will be moved into its intended position within building 10 by use of a crane or the like, and the wall panel will be moved from the exterior of the building toward the mating end portions of the base members carried by the relevant columns. Accordingly, as mounted in the columns, the base members have their mating surfaces and the mating grids thereof facing toward the exterior of the building.

As the wall panel is moved into engagement with the mating end portions of the column's base members 37, the several bolts 80 carried by the panel may not initially register in holes 48 in the cooperating base member mating end portions. Such failure of bolts 80 to register in holes 48 can be the result of positional tolerance variations which are inherent in the placement of the moieties of connector 20 in the wall panel and in the columns, or as a result of tolerance variations in the height of the column foundations which cause holes 48 not to be precisely at the desired locations above ground level 4. It will be recalled that at the time that the precast wall panel is moved into position between columns 11, the component members 38 carried by the wall panel preferably are not securely bolted to the ends of straps 31 and 32. It will also be recalled that holes 71 through the yoke arms of component members 38 are oversize, preferably by about 5/16 of an inch, relative to the diameters of the shanks of bolts 74. Similarly, holes 48 and 48' in the base and component member mating and portions preferably are oversize by about 1 inch relative to the shanks of bolts 80. Accordingly, each component member 38 can be moved along or transversely of the adjacent strap end by that amount by which holes 71 are oversize relative to the shanks of bolts 74, and the shanks of bolts 80 can be moved in holes 48 and 48' by substantial amounts. It is seen, therefore, that the component members and bolts 80 carried by them can be moved about relative to the wall panel over substantial distances adequate (a) to enable bolts 80 to be moved into registration with the cooperating holes 48 in the base members carried by the columns and (b) to enable the opposing projection grids on the mating end portions of the base and component members to register with each other in the manner shown in FIG. 10.

It will be appreciated that the opposing mating grids are matable with each other at a plurality of relative positions which are spaced from each other discrete distances along the rows and columns of the mating grids. The distances between these discrete positions are, in the presently preferred embodiment of the invention, 5/16 of an inch, which is the amount of adjustment of the component member on the strap end afforded by the oversize nature of holes 71 relative to the shanks of bolts 74. Additional adjustment capability adequate to assure that the mating grids of the base and component members can be mated to each other, with the shanks of bolts 80 projecting through base member holes 48, is afforded by the fact that holes 48 and 48' are oversize relative to the shanks of bolts 80.

The frangible and crushable nature of the material used to provide the encasement around each component member 38 and the bolts carried by it enables the heads of bolts 74 and 80 to be moved relative to the wall panel.

After the shanks of all bolts 80 carried by a wall panel have been registered in holes 48 in the base members carried by the adjacent columns, and after the mating grids on the respective base and component members have been mated properly with each other, washers and nuts 85 are placed on the shanks of bolts 80. This can be done because access to the bolt shanks is afforded by access openings 78 which also enable the base member mating end portions to move relatively toward the component member end mating portions into mating engagement of their respective mating grids. Final tightening of the nuts in each connector 20 can be deferred until some time after each wall panel has been connected between the adjacent building columns in a manner adequate to carry the weight of the wall panel. This means that if ironworkers are relied upon to secure the wall panels preliminarily in place between the columns, final tightening of nuts 76 and 85 in each connector 20 can later be performed by less skilled trades using the two-part nut driving tool described above. Access holes 77 and access openings 78 can then be filled with grout to finish the inner surface of panel 12, if desired.

The basic function of bolts 80 and nuts 85 in each connector 20 is to clamp the mating end portions of the connector moieties together adequately to maintain the mating grids of those moieties in engagement with each other. It is the projections and the recesses of the cooperating mating grids which, in the aggregate, carry all loads imposed upon the connector in the basic plane of the engaged mating grids. The shanks of bolts 80 are not relied upon to carry shear loads.

FIG. 11 is a table which sets forth certain dimensions pertinent to a connection between a wall panel and its supporting columns in building !0 depending upon where in the building the connection occurs. These dimensions are those pertinent to the presently preferred embodiment of the invention and are provided in compliance with applicable invention disclosure requirements; in general, however, they are exemplary and illustrative. In the table, the term "edge dist." describes the distance between the mounting end 62 of a connector element 38 and the nearest hole 71. The distance "S" in the table refers to the distance between centers of adjacent holes 71 in the relevant connector member 38. The number of holes in such a member is given in the description of the friction bolts.

One factor which impacts the economics of construction of multi-story precast concrete buildings is the cost of certain highly skilled trades whose participation in the construction of such buildings is required by prevailing labor contracts in many areas. Such contracts often provide that ironworkers will be employed to interconnect building components in buildings over a specified height or number of stories. This may seem anomalous as precast concrete building systems do not use the kinds of building components with which the skills of ironworks usually are associated. Ironworkers demand and receive high wages per hour. This invention provides economies in the construction of multistory precast concrete buildings by providing an improved quick-connect coupling useful for connecting certain kinds of precast concrete building elements in place during the erection of a precast concrete building. Building components can be designed so that they can rapidly be connected in place by ironworkers in a preliminary manner, and so that they can later be secured more permanently by other less highly paid trades. The invention is particularly useful for connecting precast concrete exterior wall panels in place between exterior columns of such a building.

Precise control over the distance between adjacent columns in a precast concrete building is difficult to achieve at reasonable cost. However, intercolumn spacing within specified limits, which provide acceptable spacing tolerances of an inch or so in either direction from design dimensions, is readily achieved at low cost as precast columns are erected on footings or foundations. Similar elevational variations in footing or foundation definition can also occur. The connector described above is accommodating of such spacing tolerances and elevational variations which heretofore have been accommodated by expensive welded connections and by similarly costly poured-in-place connections.

Once a wall panel has been connected between two adjacent columns in a building, the structures provided to make the necessary connections are loaded primarily in shear in vertical planes. Connection shear loads are imposed by the weight of the panel itself and also by movement of the building as it may settle during and after construction and as it may experience wind or seismic loads or movements. The connector described above effectively addresses these considerations as it is capable of carrying shear loads vertically and horizontally in the plane of the wall panel.

Additional desirable features of the connector described above is its ease of effective placement of relevant parts in or on the building components to be connected, sizing which does not affect the dimensions of the related building components as defined by structural considerations, compatibility with efficient prefabrication of the related building components, and compatibility with the esthetics of the building when erected.

Furthermore, the connector described above enables exterior precast concrete wall panels, also called spandrels, to be used effectively and efficiently to provide the requisite lateral stiffness in a building which can have windows in all exterior walls and which can have substantially open interior floor areas. The connectors thus make possible an additional type of design for multi-story reinforced concrete buildings. The new building design made possible by this invention, broadly speaking, is an X-braced space frame using precast reinforced concrete components; the X-bracing is provided by the preferably diagonally disposed steel straps in the wall panels in which the straps can carry tension or compression; the straps can carry compression loads because, by being encased in concrete between their ends, they perform in a manner akin to the performance of a column which is laterally supported in all directions at all places along its length. This new type of design is economically and mechanically efficient and enables reinforced concrete buildings to be built as cost-effective replacements for buildings which do not efficiently use available sites.

The wall panel described above is itself an improvement in precast reinforced concrete components for buildings and is a further aspect of this invention.

The structures and procedures described above and shown in the accompanying drawings are those pertinent to the presently preferred embodiment of the invention. Workers skilled in the art to which this invention pertains will appreciate that the invention can be embodied in structures and in procedures other than those described and shown, and that the foregoing is not an exhaustive catalog of all arrangements and methods by which the advances provided by this invention can be practiced. Therefore, the foregoing is illustrative, not exhaustive, of the scope and content of this invention, and the following claims are to be read and applied consistent with that circumstance.

What is claimed is:

1. A connector for mounting of building components to columns in a building, the connector comprising a base member and an element member each having a mating end portion defining a generally flat yet locally contoured mating surface, the base member having a base portion adapted to be securely affixed to a building column with the mating surface on the mating end portion thereof disposed in a desired plane relative to the column, the element member having a connection part adapted to be connected to a selected building component and to be coupled to the base member by engagement of the mating surface of its mating end portion with the mating surface of a base member and by clamping together of the mating end portions, the mating surface of each moiety being contoured to define, in a manner essentially identical to that of the other moiety's mating surface, a regular pattern of projections and recesses in each of two orthogonal directions in the mating surface, the dimensions of the projections and recesses in combination with the area thereof on the mating surfaces and with the material of which the coupling moieties are defined providing a joint of desired shear strength substantially in the plane of the mating surfaces when the mating surfaces are engaged with the projections of one mating surface disposed in the recesses of the other moiety's surface and the mating end portions are clamped together.

2. A connector according to claim 1 wherein each member is elongate between a mating end and a mounting end thereof, and the orthogonal directions are substantially parallel to and transversely of such elongate extent.

3. A connector according to claim 1 wherein the dimensions of the projections and recesses on the mating surface of one moiety in directions normal to and parallel to the mating surface are essentially the same respectively as those corresponding ones of the projections and recesses on the mating surface of the other moiety.

4. A connector according to claim 3 wherein the projections and recesses are arranged in rows and columns on each mating surface, and the projections and recesses alternate with each other in each row and column.

5. A connector according to claim 4 wherein each projection on each mating surface is essentially identical to each other projection on that mating surface and to each of the projections on the other mating surface, and each recess on each mating surface is essentially identical to each other recess on that mating surface and to each of the recesses on the other mating surface, whereby the two mating surfaces are matable with each other at a plurality of discrete relative positions along the rows and columns.

6. A connector according to claim 5 wherein each recess is substantially a negative of each projection.

7. A connector according to claim 5 wherein each projection has a substantially rectangular cross-sectional configuration at locations along its length between a base end proximate the mating surface and a tip end spaced from the base end.

8. A connector according to claim 7 wherein said cross-sectional configuration of each projection is substantially a square.

9. A connector according to claim 7 wherein the sides of the rectangular cross-section of each projection are disposed substantially parallel to the directions of the respective rows and columns.

10. A connector according to claim 9 wherein each projection is tapered between its ends in at least one direction between opposing sides of its rectangular cross-sectional configuration.

11. A connector according to claim 10 wherein the corners of each projection are chambered in a diminishing fashion proceeding from its base end toward its tip end.

12. A connector according to claim 7 wherein the tip ends of the projections on each mating surface are substantially parallel to the mating surface and are disposed substantially in a common plane substantially parallel to the mating surface.

13. A connector according to claim 3 including at least one hole through each moiety in association with the pattern of projections and recesses on that moiety's mating surface and disposed for substantial alignment with the hole through the other moiety upon mating of the moieties' mating surfaces, the holes as substantially aligned being adapted to receive the shanks of a corresponding number of clamping devices operable for clamping the mated moiety end portions together.

14. A connector according to claim 5 including at least one hole through each moiety in association with the pattern of projections and recesses on that moiety's mating surface in a place on the moiety selected for substantial alignment with a corresponding hole through the other moiety upon mating of the moieties' mating surfaces and for receiving the shank of a corresponding clamping device operable for clamping the mated moiety end portions together, the holes being a selected amount oversize relative to the size of the clamping device shanks.

15. A connector according to claim 14 wherein the amount by which the holes are oversize is at least equal to the distance between adjacent ones of said discrete relative positions.

16. A connector according to claim 14 wherein the holes are located in each moiety substantially centrally of the pattern of projections and recesses.

17. A connector according to claim 14 wherein there are at least two holes in each moiety.

18. A connector according to claim 14 including means defined by each moiety in association with the hole for establishing the depth to which that moiety's projections are engageable in the recesses of the other moiety.

19. A connector according to claim 1 wherein the base member carries on the base portion thereof a plurality of ear-like projections adapting said base portion to be embedded in a reinforced concrete column for secure affixation to the column.

20. A connector according to claim 19 wherein the ear-like projections are disposed on opposite sides of the base member.

21. A connector according to claim 1 wherein the building component to which the connector element member is adapted to be connected is a building exterior wall panel.

22. A connector according to claim 21 wherein the wall panel is a precast reinforced concrete wall panel having a selected length between opposite ends, a selected height transversely of the elongate extent of the panel between its ends, and a selected thickness, the panel having encased therein a pair of steel straps which are not bonded to the concrete, each strap having its opposite ends disposed at the opposite ends of the panel, and wherein the element member of the connector is connectible to a strap end via its connection part.

23. A connector according to claim 22 wherein the connection part of the connector element member defines an elongate arm adapted to be disposed in overlying relation to an adjacent strap end in substantial alignment with the length of the strap and to be connected to the strap for application of loads to the strap in either direction along the length of the strap.

24. A connector according to claim 23 wherein the connection part comprises a pair of arms between which an adjacent strap end is disposable in connection of the strap to the strap end.

25. A connector according to claim 24 including doublering means affixed to the strap end between the connection part arms.

26. A connector according to claim 24 including a plurality of holes through the arms and the strap end for receipt of the shanks of fastener elements operable for connecting the strap end between the arms, the shanks cooperating snugly in the holes in the strap end, the holes in the arms being a selected amount oversize relative to said shanks.

27. A connector for mounting of a precast reinforced concrete wall panel between a pair of reinforced concrete columns in a building, the connector comprising a base member and an element member each having a mating end portion defining a generally flat yet locally contoured mating surface, the base member having a base portion adapted to be securely embedded in a building column with the mating surface on the mating end portion thereof projecting from a selected side of the column and disposed in a substantially vertical plane with the mating surface facing in a selected direction common to any other such base member mating end portions which project from the same side of the column, the element member having a connection part adapted to be connected to an end of a steel strap encased in concrete comprising the wall panel and to be coupled to the base member by engagement of the mating surface of its mating end portion with the mating surface of the base member and by clamping together of the mating end portions, the mating end portion of each coupling moiety having at least one hole through it and the mating surface thereof, the mating surface of each moiety being contoured to define, in a manner essentially identical to that of the other moiety's mating surface, a regular pattern of projections and recesses arranged alternately in orthogonal rows and columns in the mating surface, the dimensions of the projections and recesses in combination with the area thereof on the mating surfaces and with the material of which the coupling moieties are defined providing a joint of desired shear strength substantially in the plane of the mating surfaces when the mating surfaces are engaged with the projections of one mating surface disposed in the recesses of the other moiety' surface and the mating end portions are clamped together via means cooperating in the holes through them.

28. A method for mounting a precast reinforced concrete wall panel between a pair of columns in a building, the method comprising the steps of:

(a) prefabricating a precast reinforced concrete wall panel which is elongate between opposite ends and which has interior and exterior major surfaces, including providing in the panel at least a pair of steel straps which are embedded in, but no bonded to, the concrete and which extend between ends proximate the opposite ends of the panel;

(b) providing a connector for each end of each strap in the panel, each connector comprising as moieties thereof first and second members each having a mating end portion having a mating surface in which is defined a pattern of projections and recesses, wherein the pattern and details thereof in one member's mating surface are matably conjugate to those of the other member's mating surface;

(c) connecting to each end of each strap one of the moieties of a connector as aforesaid with the mating surface on the mating end portion thereof facing toward a selected panel surface;

(d) mounting to the columns at selected places thereon and in selected attitudes the other moieties of the connectors with the mating end portions thereof projecting from the columns and with the mating surfaces thereof facing in a common direction;

(e) moving the panel into place between the columns and registering the projections on the connector member moieties carried by the panel of the connector member moieties mounted to the columns; and (f) clamping together the moieties of the several connectors to define connections betweent he panel and the columns in which lateral shear loads therebetween are carried by the intermated conjugate projections and recesses of the end portions of the connector moieties.

29. The method according to claim 28 including connecting the one connector moieties to the strap ends within recesses formed in the panel's selected surface with the mating surfaces of such moieties facing toward the panel's selected surface.

30. The method according to claim 29 including connecting the one connector moieties to the strap ends loosely in a manner which affords limited positioned adjustability of the moieties on the strap ends, and securing the moieties from such adjustability after registering the projections of the moieties carried by the panel in the recesses of the moieties mounted to the columns.

31. The method according to claim 30 wherein the step of providing the connectors include providing the projections and recesses in the mating surface of each connector member as a regular pattern thereof in which each projection on one mating surface is matable in any recess on the mating surface of the other member of the connector.

32. The method according to claim 31 including providing the projections and recesses on each connector moiety mating surface in rows and columns on the surface with the projections and recesses alternating in each row and columns.

33. The method according to claim 31 including clamping the moieties of such connector together by sue of bolts passed through holes in the mating end portions of the moieties.

34. The method according to claim 33 wherein the clamping step is performed using bolts having shanks undersize a selected amount relative to the holes in the corresponding connector members mating end portions.

35. The method according to claim 29 wherein the step of prefabricating the wall panel includes the step of connecting the one connector moieties to the strap ends before pouring the concrete, and including forming the recesses around the strap ends and the one connector moieties in the course of pouring the concrete.

36. The method according to claim 35 wherein the step of forming the recesses includes disposing around the strap ends and the one connector moieties frangible forms which are contoured to define the recesses upon subsequent pouring of concrete therearound.

37. The method according to claim 36 including disposing selected elements of fastener sets through the strap ends and the one connector moieties before disposing the frangible forms therearound.

38. The method according to claim 37 including removing at least portions of the frangible forms after pouring of concrete therearound to expose the fastener set elements and the mating surfaces of the one connector moieties.

39. The method according to claim 28 wherein the step of prefabricating the panel includes providing around each strap and in the panel between the strap ends a network of metal concrete reinforcing elements.

40. The method according to claim 28 wherein the columns are precast reinforced concrete columns, and including mounting the other moieties to the columns in the course of casting the columns.

41. The method according to claim 40 including embedding selected portions of the other moieties in the columns.

42. The method according to claim 28 wherein movement of the panel relative to the columns productive of registration of the projections and recesses of the several cooperating moieties in essentially linear motion from said common direction.

43. A precast reinforced concrete exterior wall panel adapted to be connected in a building between a pair of building columns, the panel being generally planar between opposite ends comprising principally concrete cast around a network of metal reinforcing members, the cast panel including a pair of elongate metal straps disposed within but not bonded to the concrete between opposite ends of the straps located adjacent the respective ends of the panel.

44. A panel according to claim 43 wherein the strap ends are disposed in respective recesses defined in the panel at the ends thereof and the recesses open toward a selected one of two opposite major faces of he panel.

45. A panel according to claim 44 wherein each strap end carries a first moiety of a quick-connect coupling capable, upon connection of the moiety with a second moiety of the coupling, of transferring to and from the straps shear loads in the plane of the strap and along the length thereof.

46. A panel according to claim 45 wherein each first moiety is disposed in the adjacent recess for mating with the second moiety of the coupling, each second moiety being adapted to be carried by a column.

47. A panel according to claim 46 wherein the moieties of each coupling are arranged for mating by lineal movement of one toward the other, and the first moieties are disposed in the panel so that the line of such movement is substantially normal to the plane of the panel, and wherein the moieties of each coupling are defined to be clamped together upon mating thereof.

48. A panel according to claim 46 wherein the first moieties of the couplings are carried on the strap ends for positional adjustment on the strap ends.

49. A panel according to claim 43 wherein the panel is substantially rectangular in the plane thereof, and the straps are disposed substantially along respective diagonals of the panel.

50. A building construction system for multi-story buildings having exterior columns and wall panels connected between columns at the building floor levels above ground level, the system comprising a plurality of precast reinforced concrete columns erected on foundations at spaced locations along the perimeter of the building, and a plurality of precast reinforced concrete wall panels connected between adjacent columns via connector assemblies having cooperating first and second moieties carried respectively by the panels and the columns at selected locations thereof, the moieties of each connector assembly being defined for bolted mating engagement of each to the other through substantially horizontal movement of the panels into place in the building and for carrying lateral shear loads between the panel and the columns via mating features of the moieties rather than via bolts connected between the moieties for holding them in mated engagement, the panels including steel straps encased therein in unbonded relation to the concrete defining the panels, the straps in each panel extending between opposite ends thereof at the opposite ends of the panel and carrying first moieties of the connector assemblies at their ends, the second moieties of the connector assemblies for each panel being affixed to the corresponding columns at spaced locations therealong.

51. A building system according to claim 50 wherein each panel has inner and outer opposite major faces and upper and lower edges between the ends thereof, and including reinforcement elements extending from the panel inner faces generally along lines across the inner faces substantially parallel to the panel upper and lower edges for embedment in poured-in-place floors of the building.

52. A building system according to claim 50 wherein the mating features of the connector assembly first and second moieties comprise substantially identical patterns of projections and recesses in which each projection in one surface is matable in a recess in the other surface for carrying shear loads in vertical and horizontal directions in the mating surface of the first moiety which is substantially parallel to the opposite major faces of the panel.

53. A building system according to claim 52 wherein, in each moiety's mating surface, the recesses and projections are disposed alternately in rows and columns in the surface.

54. A building system according to claim 52 wherein the connector assembly first moieties define threaded shanks engageable through holes in the second moieties for receipt of nuts threadable on the shanks for clamping the moieties of each assembly to each other upon engagement of the projections of each in the recesses of the other.

55. A building system according to claim 54 wherein the connector assembly first moieties carried by each panel are disposed in a recess formed in an inner force of the panel at the corresponding end of the panel.

56. A building system according to claim 50 wherein each panel has substantially rectangular opposite major forces, and the straps are disposed substantially along the diagonals of the panel.

57. A building system according to claim 50 wherein each strap is surrounded between its ends by a respective reinforcement cage embedded in the concrete of the panel.

* * * * *

UNITED STATES PATENT AND TRADEMARK OFFICE

CERTIFICATE OF CORRECTION

PATENT NO. : 4,819,394

DATED : April 11, 1989

INVENTOR(S) : Lloyd A. Compton

It is certified that error appears in the above-identified patent and that said Letters Patent is hereby corrected as shown below:

Col. 3, line 31, before "one" delete -- a -- . Col. 3, line 66, after "levels" insert -- 18 -- .

Col. 4, line 23, change "space" to -- spaces -- .

Col. 6, line 2, change the phrase "substantial shear loads" to -- substantial loads which are seen as shear loads -- .

Col. 9, line 46, change "magnitude" to -- magnitudes--

Col. 10, line 8, change "Calif." to -- California -- .

Col. 12, line 53, change "!0" to -- 10 -- .

Col. 13, line 47, after "above" change "is" to --are--

Col. 15, line 30, change "chambered" to -- chamfered-- Col. 15, line 57, change "shanks" to -- shank -- .

UNITED STATES PATENT AND TRADEMARK OFFICE

CERTIFICATE OF CORRECTION

PATENT NO. : 4,819,394

DATED : April 11, 1989

INVENTOR(S) : Lloyd A. Compton

It is certified that error appears in the above-identified patent and that said Letters Patent is hereby corrected as shown below:

Col. 17, line 22, change "no" to -- not -- . Col. 17, line 49, change "betweent he" to -- between the -- . Col. 17, line 61, change "positioned" to -- positional -- . Col. 17, line 68, change "include" to -- includes -- .

Col. 18, line 13, change "sue" to -- use -- . Col. 18, line 54, before "essentially" change "in" to -- is -- . Col. 18, line 68, change "he" to -- the -- .

Col. 20, line 36, change "force" to -- face -- .

Signed and Sealed this

Twentieth Day of February, 1990

*Attest:*

JEFFREY M. SAMUELS

*Attesting Officer* *Acting Commissioner of Patents and Trademarks*